US005381607A

United States Patent [19]

Sussmann

[11] Patent Number: 5,381,607

[45] Date of Patent: Jan. 17, 1995

[54] STABILIZED HONEYCOMB SHOE SOLE, PARTICULARLY FOR ATHLETIC SHOES

[75] Inventor: Reinhold Sussmann, Scheinfeld, Germany

[73] Assignee: Tretorn AB, Heisingborg, Sweden

[21] Appl. No.: 209,983

[22] Filed: Mar. 10, 1994

Related U.S. Application Data

[63] Continuation of Ser. No. 904,667, Jun. 26, 1992, abandoned.

[30] Foreign Application Priority Data

Jun. 26, 1991 [DE] Germany ..... 4121042

[51] Int. Cl.[6] ..... A43B 13/18

[52] U.S. Cl. ..... 36/28; 36/30 R

[58] Field of Search ..... 36/28, 30 R, 31, 30 A, 36/59 C, 29, 71, 3 B, 44, 143, 144, 149, 154, 169; 428/116–118; 5/449, 481, 455

[56] References Cited

U.S. PATENT DOCUMENTS

| | | | |
|---|---|---|---|
| 532,429 | 1/1895 | Rogers | 36/28 |
| 3,087,262 | 4/1963 | Russel | 36/28 |
| 4,223,455 | 9/1980 | Vermuelen | 36/29 |
| 4,245,406 | 1/1981 | Landay et al. | 36/14 |
| 4,297,796 | 11/1981 | Stirtz et al. | 36/28 |
| 4,449,307 | 5/1984 | Stubblefield | 36/32 R |
| 4,485,568 | 12/1984 | Landi et al. | 36/28 |
| 4,486,964 | 12/1984 | Rudy . | |
| 4,506,460 | 3/1985 | Rudy . | |
| 4,897,936 | 2/1990 | Fuerst | 36/31 |
| 5,084,987 | 2/1992 | Flemming | 36/28 |
| 5,134,794 | 8/1992 | Woitschaetzke et al. | 36/30 R |
| 5,197,206 | 3/1993 | Shorten | 36/28 |
| 5,197,207 | 3/1993 | Shorten | 36/28 |

FOREIGN PATENT DOCUMENTS

| | | |
|---|---|---|
| 8714058 | 5/1988 | Germany . |
| 510426 | 8/1939 | United Kingdom . |

*Primary Examiner*—Paul T. Sewell
*Assistant Examiner*—Thomas P. Hilliard
*Attorney, Agent, or Firm*—Sixbey, Friedman, Leedom & Ferguson

[57] ABSTRACT

In a shoe sole, in particular for athletic shoes, that is assembled at least from an outsole and a cushioning midsole, where the midsole has recesses extending essentially perpendicular to the plane of the sole, to improve the comfort of such a shoe and to increase the dimensional stability of the sole parts, the midsole is formed of a first midsole element (1*a*) consisting of a compact thermoplastic material and a second midsole element (2*a*) consisting of a foamed plastic material. Recesses (3) are distributed at least predominantly over the entire first midsole element (1*a*) made of compact thermoplastic material and are closed on a side facing away from the second midsole element (2*a*). Additionally, the second midsole element (2*a*) is injected onto the first midsole element (1*a*) closing open ends of the recesses and optionally, partially penetrating the recesses and/or encapsulating stabilizing inserts disposed in the arch area of the first midsole element.

20 Claims, 2 Drawing Sheets

FIG. 1
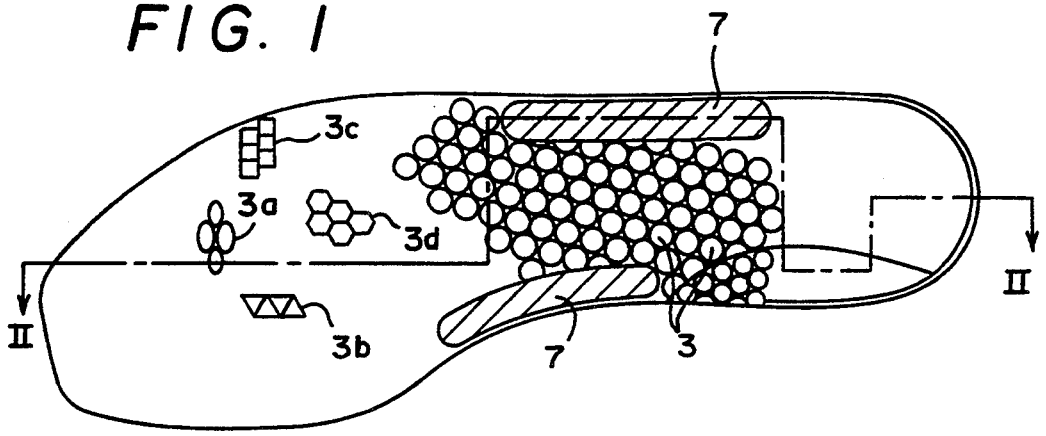
FIG. 2
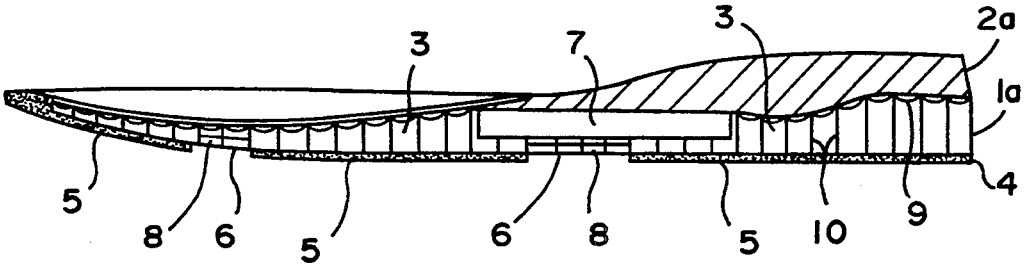
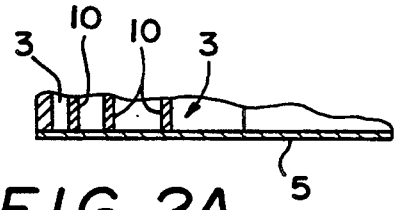
FIG. 2A
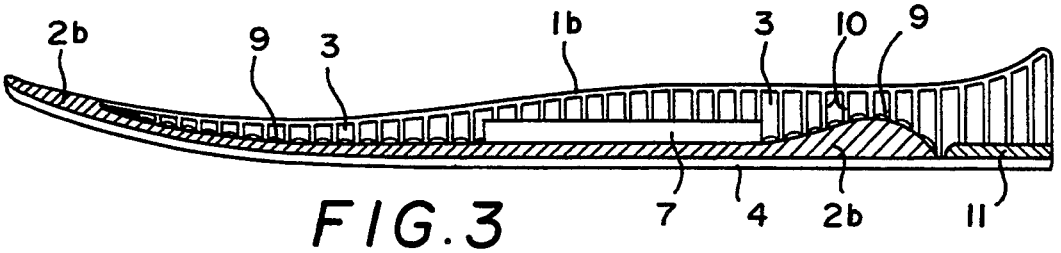
FIG. 3

STABILIZED HONEYCOMB SHOE SOLE, PARTICULARLY FOR ATHLETIC SHOES

This application is a continuation of Ser. No. 07/904,667, filed Jun. 26, 1992, now abandoned.

BACKGROUND OF THE INVENTION

The present invention relates to a shoe sole, in particular for athletic shoes, that has an outsole and a cushioning midsole, and parts of the midsole comprise recesses or cells that extend essentially perpendicular to the plane of the sole.

Such a shoe sole is known from German Utility Model 89 01 235 and its corresponding U.S. Pat. No. 5,084,987. In this known shoe sole, honeycomb cells or recesses, that extend perpendicular to the plane of the sole, are placed only in the central area under the heel bone or heel bone and ball of the foot to achieve there, on the one hand, good damping, but on the other hand, also to achieve high resiliency, and the entire midsole consists of foamed plastic. Similarly, U.S. Pat. No. 4,245,406 shows an athletic shoe in which the entire midsole is formed of a foamed plastic material, and a honeycomb-like structure of hollow regions and ridges is created in the region extending rearwardly of the metatarsal area.

Furthermore, from U.S. Pat. No. 4,449,307 and U.K. Patent 510,426, outsoles are known which are formed of a compact, i.e., unfoamed, plastic or rubber material in which arrangements of ridges and recesses are formed at the upper surface thereof to increase the flexibility of the outsole. In shoes with these soles, the insole or footbed sits directly on the outsole without any cushioning midsole being provided. Likewise, in German Utility Model No. 87 14 058, a sole is formed of a compact, i.e., unfoamed, gum rubber material in which arrangements of lamellae-like ridges form air chambers that are open toward the tread surface of the sole but are closed by the tread layer that is applied to the bottom of the sole. The top of the sole is closed and in one embodiment, a footbed of a foamed material is applied thereon which has channels which enable the air chambers to "breath" through the footbed.

SUMMARY OF THE INVENTION

The object of the present invention is further to improve the comfort of an athletic shoe with a shoe sole of the above-mentioned type by extending the ability to obtain the good damping with simultaneous high resilience achievable in the initially mentioned known shoe sole, preferably only under the heel bone, to other areas of the shoe.

Further, another object is to improve the dimensional stability of the sole parts to be able to maintain tighter tolerances in production without increased expense.

These objects are achieved, according to preferred embodiments of the invention, in that the midsole is formed of a first midsole element consisting of a compact thermoplastic material and of a second midsole element consisting of a foamed plastic. A honeycomb-like array of cells or recesses are distributed at least predominantly over the entire first midsole element and these recesses are closed on a side facing away from the second midsole element, which is injected onto the first midsole element.

These objects are further achieved by a preferred process in which the midsole, having the first midsole element formed of a compact thermoplastic material and the second midsole formed of the foamed plastic material, is produced in the following process steps:

- the first midsole element is injection molded with recesses extending essentially over the whole area thereof which are closed on one side;
- the finished first midsole element is inserted into a mold with a large mold cavity, with the sole side on which the recesses are closed lying on top, and liquid plastic is injected into the space remaining in the mold and foamed to form the second midsole element.

To achieve good adhesion between the first and the second midsole element, according to a further development of the invention, the foamed plastic of the second midsole element extends partially into the recesses of the first midsole element, preferably about 1 mm to 3 mm, by a suitable dosing of the plastic injected into the mold.

As a material for the first midsole element, a polyamide or polyurethane with a specific weight of 0.9 g/cm$^3$ to 1.1 g/cm$^3$ is provided, but for the second midsole element, foamed polyurethane with a specific weight of 0.3 g/cm$^3$ to 0.8 g/cm$^3$ is utilized.

The cells or recesses of the honeycomb structure formed in the first midsole part can be of a variety of different cross-sectional shapes; for example, circular, elliptical, triangular, rectangular, hexagonal or cross sections shaped like other geometric figures may be used. The recesses should have smaller cross sections and/or thicker walls in areas which experience higher loads than in areas which are subjected to lower loads.

To stabilize the midsole in the joint (arch) area, in the first midsole element, there are provided two or more rod-shaped or tubular stabilizers consisting of hard, preferably springy, plastic. These stabilizers are inserted into the first midsole element before injection of the second midsole element onto the first midsole element, preferably in the area of the ankle, near the lateral and medial sides and essentially parallel to them. When the second midsole element is injected, these stabilizers are encapsulated by the foamed plastic material.

According to a first embodiment, the first midsole element is placed beneath the second midsole element and is produced integrally together with the outsole. The outsole consists of wear-resistant plastic or rubber in areas that are subjected to high loads in use, but in areas that experience lower loads, the outsole is left open.

According to a second embodiment, the first midsole element is placed above the second midsole element, and the first midsole element does not extend over the entire surface of the second midsole element, but leaves open, in the toe area, a section encompassing an area that is at least about 1 cm to 2 cm wide and that is filled by foamed plastic of the second midsole element. On the other hand, the second midsole element does not extend over the entire surface of the first midsole element, but leaves open, in the heel area, a section of about 3 cm to 5 cm that is filled out, between the first midsole element and the outsole, with a compact plastic that may be the same as the material of the first midsole element or rubber.

The advantages achieved with the invention are especially related to the fact that, with the air chambers formed in the first midsole element, the damping and the resilience in various areas of the sole can be selected individually. This is achieved, in particular, by using a plastic with a varying amount of foaming agent in various areas of the second midsole element.

Further, the compact, i.e., unfoamed, thermoplastic material used for the first midsole element makes possible a greater dimensional stability of the midsole. Thus, the finished sole has a greater dimensional stability, overall. The dimensional stability becomes greater the larger the amount of compact plastic as compared to the foamed plastic, because a compact plastic part can be poured or injected much more exactly than a foamed plastic part.

In particular, the hardness of the second midsole element consisting of foamed plastic varies quite considerably with its thickness. In sole areas with thicker walls of the foamed second midsole element, a higher degree of foaming is achieved, and thus a lower Shore hardness, than in sole areas in which the wall thickness of the foamed second midsole element is less. The less the wall thickness of an element consisting of foamed plastic, the higher also is the material density. Consequently, it is extremely difficult to inject foamed midsole elements or parts of them with close tolerances. Therefore, the lower the amount of the foamed second midsole element as compared to the entire midsole, the more the dimensional stability of the midsole according to the invention can be increased and the lower the expense will be.

Finally, because of the fact that the second midsole element contributes considerably to the pressure distribution between the recesses of the first midsole element and the foot of the wearer, another advantage is achieved in that biomechanical functions can be supported by adjusting, in any way, the thicknesses of the second midsole element in various areas.

The higher weight caused, basically, by the compact plastic used for the first midsole element is compensated for, very largely, by the recesses that are, preferably, distributed over the entire first midsole element.

The embodiment according to the second alternative, in which the first midsole element is placed above the second midsole element and the first midsole element does not extend over the entire surface of the second midsole element, but leaves a section open in the toe area that is filled by foamed plastic of the second midsole element has, in particular, the advantage that, for the first midsole element, a single mold suffices for several main and intermediate sizes of the shoe to be produced. That is, depending on the shoe size, the toe area with foamed plastic of the second midsole element can be made larger or smaller. This means that, with the injection mold for shoe size 8, for example, midsoles for shoe sizes 8½, 9 and 9½ can also be produced. The size difference is compensated for by modifying the mold for the lower second midsole element to be produced of foamed plastic. The costs for the molds are thus reduced overall.

By the additional measure according to which the second midsole element does not extend over the entire surface of the first midsole element but leaves open a section in the heel area that is filled with compact plastic of the first midsole element or with elasticity-increasing rubber up to the outsole, the advantage is achieved that the amount of foamed plastic, which is more susceptible to bacteria, of the second midsole element is not increased, or at least not considerably increased, despite the extension at the tip of the foot, inasmuch as compensation is made at the heel. Further, the precision of the fit of the entire sole is increased, since the lower surface of the first midsole element made of compact plastic, which extends in the heel area to the outsole or to the inserted rubber layer, reduces the lower surface of the second, foamed midsole element.

With respect to the production process, the advantages achieved include, in particular, the fact that the desired air chambers are produced in a simple way.

These and other objects, features and advantages of the present invention will become apparent from the following detailed description of preferred embodiments of the invention when viewed in conjunction with the accompanying drawings.

BRIEF DESCRIPTION OF THE DRAWINGS

FIG. 1 is a top view of a first midsole element;

FIG. 2 is a section taken along line II—II in FIG. 1, showing the first midsole element with a second midsole element already injected above the first midsole element;

FIG. 2A is an enlarged cross-sectional side view of a portion of first midsole element of FIG. 2 showing a modified form thereof; and FIG. 3 is a sectional via similar to that of FIG. 2 but of another embodiment of a midsole, in which the already injected, second midsole element is placed beneath the first midsole element.

DETAILED DESCRIPTION OF THE PREFERRED EMBODIMENTS

Figure 1A:
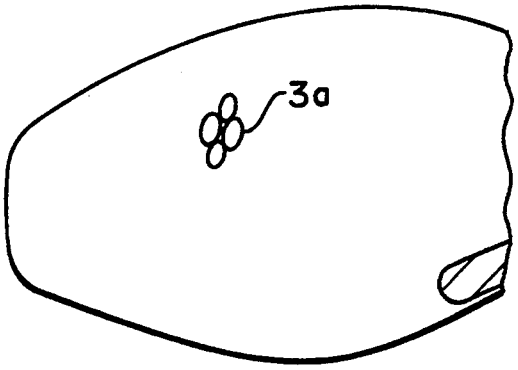
FIGS. 1A–1D show the front part of a first midsole element as in FIG. 1 but with alternate shapes for the cells thereof.
Figure 1B:
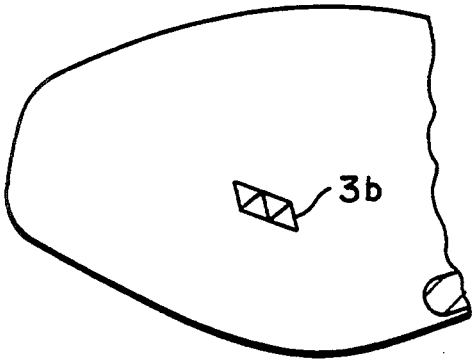
Figure 1C:
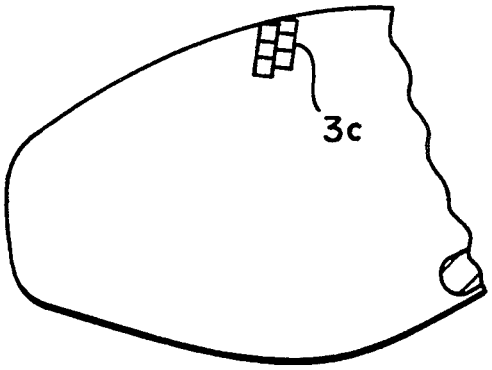
Figure 1D:
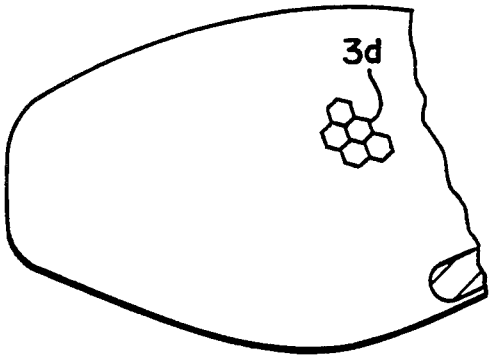

In the top view of FIG. 1, a top side of a first midsole element, 1*a* (FIG. 2), 1*b* (FIG. 3) is shown. This first midsole element is formed of a compact, i.e., unfoamed, thermoplastic material, with a honeycomb-like array of cells or recesses 3 being distributed over essentially the entire sole area (these cells or recesses are only partially shown for illustrative simplicity). Furthermore, rod-shaped or tubular stabilizers 7, that are made of a hard, preferably springy plastic, are placed under the area of the ankle and are inserted in grooves that are left open during production of first midsole element 1*a*, 1*b*. Basically, more than the two stabilizers 7 shown diagrammatically can be provided, and optionally, other stabilizers are placed closely adjacent to diagrammatically shown stabilizers 7, running essentially parallel to them. Stabilizers 7 increase the torsion resistance of midsole 1*a*, 2*a* (FIG. 2), 1*b*, 2*b* (FIG. 3). As a material for stabilizers 7, compact polyurethane, polyamide, or polyethylene is suitable.

The cells or recesses 3 of the honeycomb structure formed in the first midsole element 1 can be a variety of different cross-sectional shapes; for example, in addition to circular recesses 3, elliptical, triangular, rectangular, hexagonanl (3*a*, 3*b*, 3*c*, and 3*d*, respectively in FIGS. 1A to 1D) or cross sections shaped like other geometric figures may be used. The recesses should have smaller cross sections and/or thicker walls in areas which experience higher loads than in which are subjected to lower loads, and by way of example, FIG. 2A shows a portion of a first midsole element 1 having walls 10 of differing thickness and recesses 3 of different cross section.

The sectional view of FIG. 2, taken along line II—II of FIG. 1, shows first midsole element 1*a* with recesses 3, as well as a second midsole element 2*a* injected on the top side of the first midsole element and consisting of a foamed plastic material. Additionally, an outsole 4 is shown that has been injected onto the lower side of the first midsole element 1*a* in highly loaded areas 5. Outsole 4 is made of a wear-resistant plastic or rubber, which is left open in areas 6 which experience lower loads in use. This outsole 4 is simultaneously used as a closure for the lower end of recesses 3 while, in the areas that are not covered by the outsole, recesses 3 are, preferably, closed by partitions 8 that are inserted within them.

With reference to FIG. 3, a section of another embodiment is shown. In this embodiment, a first midsole element 1*b* with recesses 3 has a second midsole element 2*b* that has been injected onto the underside of midsole element 1*b*. Midsole element 2*b* is a layer of foamed plastic, and an outsole 4 made of wear-resistant plastic is injected onto the lower side of the midsole element 2*b*. Additionally, second midsole element 2*b* does not extend rearwardly across the full heel area, and an elasticity-increasing rubber layer 11 is inserted in the heel area between the first midsole element 1*b* and the outsole 4.

As can clearly be seen in FIGS. 2 and 3, some foamed plastic 9 penetrates into recesses 3 during injection of second midsole element 2*a*, 2*b*. The diagrammatic representation makes clear that, because of the varying volumes of recesses 3 along the extent of first midsole element 1*a*, 1*b*, the air remaining within the recesses 3 is more or less compressed depending on the degree of penetration of the foam and the volume of the recesses. As a result, by selecting the length of walls 10 that define the recesses 3, the damping and the resilience of midsole 1*a*, 2*a*; 1*b*, 2*b*, in different areas of the sole can be selected individually, without having to work with varying amounts of foaming agent in forming the second midsole element 2*a*, 2*b*.

Also, when recesses 3 extend, in particular for weight reasons, preferably over the entire area of first midsole element 1*a*, 1*b*, a modified embodiment can also be advantageous in which, in any case, the perimetric edge areas of first midsole element 1*a*, 1*b* are not provided with recesses 3. In the joint (arch) area, the inside (medial) or outside (lateral) edge areas without recesses 3 could be kept, basically, wider than in the other sole areas, to optionally enable stabilizers 7 to be dispensed with. That is, the wider, solid border portions of the compact plastic material of the first midsole layer can function, themselves, as stabilizers.

Outsole 4 is provided, depending on the specific use of the shoe, in particular for an athletic shoe, with the usual cleats, ridges, bumps or other gripping elements which increase surefootedness. Diagrammatic representation of these gripping elements, which are known in the art, has been dispensed with for the sake of clarity of the representation.

The areas of first midsole element 1*a*, according to FIG. 2, that are not covered by outsole 4 can be provided with convex, i.e., inward-pointed, arches, to further reduce the sole weight. Partitions 8, provided in recesses 3, constitute a blocking layer against penetration of foreign matter into midsole 1*a*, 2*a* and are, preferably, set back about 1 mm to 2 mm relative to the side of first midsole element la that adjoins the outsole 5.

I claim:

1. Shoe sole comprising at least an outsole and a cushioning midsole, the midsole being formed of a first midsole element made of a body of compact thermoplastic material and of a second midsole element that is made of an applied thickness of foamed plastic material, wherein a honeycomb-like array of cellular recesses are distributed at least predominantly over the entire first midsole element, said recesses extending vertically through the body of the first midsole element, having a vertical height which, over a major portion of the first midsole element, is at least substantially as great as the applied thickness of foamed plastic material and being closed by the material of the body at a side of the first midsole element that faces away from the second midsole element; and wherein said second midsole element is solidified to the first midsole element so as to be unified therewith by having been molded onto a side of the first midsole element at which openings of the cellular recesses are located.

2. Shoe sole according to claim 1, wherein the foamed plastic material of the second midsole element permanently extends partially into said recesses of the first midsole element in a manner sealing the openings of the cellular recesses and resulting in the entrapping of air in the recesses of the first midsole element.

3. Shoe sole according to claim 2, wherein the foamed plastic material of the second midsole element extends into said recesses of the first midsole element about 1 mm to 3 mm.

4. Shoe sole according to claim 1, wherein the first midsole element consists of a polyamide or polyurethane with a specific weight of 0.9 $g/cm^3$ to 1.1 $g/cm^3$.

5. Shoe sole according to claim 4, wherein the second midsole element consists of foamed polyurethane with a specific weight of 0.3 $g/cm^3$ to 0.8 $g/cm^3$.

6. Shoe sole according to claim 1, wherein said recesses have a cross-sectional shape selected from the group consisting of circular, elliptical, triangular, rectangular, hexagonal, or other geometric shapes.

7. Shoe sole according to claim 1, wherein said recesses have at least one of smaller cross sections and thicker walls in areas subjected to higher loads in use than in areas which experience lower loads.

8. Shoe sole comprising at least an outsole and a cushioning midsole, being formed of a first midsole element made of a compact thermoplastic material and of a second midsole element that is made of a foamed material, wherein a honeycomb-like array of recesses are distributed at least predominantly over the entire first midsole element, said recesses extending vertically through the first midsole element and being closed at a side of the first midsole element that faces away from the second midsole element; wherein said second midsole element is connected to the first midsole element by having been molded thereon; and wherein the first midsole element has at least two stabilizers of a solid or tubular rod shape disposed therein, said stabilizers being made of a hard plastic material.

9. Shoe sole according to claim 8, wherein said at least two stabilizers are located in an ankle area near lengthwise extending sides of the sole, oriented essentially parallel to them.

10. Shoe sole according to claim 7, wherein the first midsole element is located beneath the second midsole element.

11. Shoe sole according to claim 1, wherein the first midsole element is located beneath the second midsole element.

12. Shoe sole according to claim 11, wherein the first midsole element is integrally joined with the outsole.

13. Shoe sole according to claim 12, wherein the outsole consists of wear-resistant plastic or rubber material, at least in areas and is open in selected other areas.

14. Shoe sole according to claim 7, wherein the first midsole element is located above the second midsole element.

15. Shoe sole according to claim 1, wherein the first midsole element is located above the second midsole element.

16. Shoe sole according to claim 15, wherein the first midsole element covers less than the entire surface area of the second midsole element, leaving the second midsole uncovered by the first midsole element in a toe area that is a section at least 1 cm to 2 cm wide, said toe area section being filled out by foamed plastic material of the second midsole element.

17. Shoe sole according to claim 16, wherein the second midsole element covers less than the entire surface of the first midsole element, leaving the first midsole element uncovered by the second midsole element in a heel area that is a section of about 3 cm to 5 cm, said heel area section being filled with the compact plastic material of the first midsole element or with rubber between the first midsole element and the outsole.

18. Shoe sole according to claim 15, wherein the second midsole element covers less than the entire surface of the first midsole element, leaving the first midsole element uncovered by the second midsole element in a heel area that is a section of about 3 cm to 5 cm, said heel area section being filled with the compact plastic material of the first midsole element or with rubber between the first midsole element and the outside.

19. Shoe sole according to claim 2, wherein the midsole elements are layers extending substantially over the full length of the sole.

20. Shoe sole according to claim 19, wherein the first midsole element has at least two stabilizers of a solid or tubular rod shape disposed therein, said stabilizers being made of a hard plastic material; and wherein said at least two stabilizers are located in an ankle area near lengthwise extending sides of the sole, oriented essentially parallel to them.

* * * * *